US011699545B2

(12) United States Patent
Li et al.

(10) Patent No.: US 11,699,545 B2
(45) Date of Patent: Jul. 11, 2023

(54) COIL STRUCTURE

(71) Applicant: TDK CORPORATION, Tokyo (JP)

(72) Inventors: Ge Li, Tokyo (JP); Junpei Sawayama, Tokyo (JP)

(73) Assignee: TDK CORPORATION, Tokyo (JP)

( * ) Notice: Subject to any disclaimer, the term of this patent is extended or adjusted under 35 U.S.C. 154(b) by 361 days.

(21) Appl. No.: 17/128,331

(22) Filed: Dec. 21, 2020

(65) Prior Publication Data

US 2021/0193364 A1 Jun. 24, 2021

(30) Foreign Application Priority Data

Dec. 23, 2019 (JP) ..... 2019-232038

(51) Int. Cl.
*H01F 27/32* (2006.01)
*H01F 27/26* (2006.01)
*H01F 27/28* (2006.01)

(52) U.S. Cl.
CPC ..... *H01F 27/263* (2013.01); *H01F 27/28* (2013.01); *H01F 27/32* (2013.01)

(58) Field of Classification Search
CPC ..... H01F 27/263; H01F 27/28; H01F 3/14; H01F 27/22; H01F 27/266; H01F 27/2804; H01F 27/324; H01F 27/24
See application file for complete search history.

(56) References Cited

U.S. PATENT DOCUMENTS

2009/0115564 A1 5/2009 Minteer
2014/0266550 A1* 9/2014 Turnbull ..... H01F 17/0006 336/200
2019/0348213 A1 11/2019 Ikarashi et al.
2020/0013542 A1 1/2020 Nanbara et al.

FOREIGN PATENT DOCUMENTS

JP 2012-038941 A 2/2012
JP 2018-148020 A 9/2018
JP 2019-047105 A 3/2019
WO WO-2017178374 A1 * 10/2017 ..... H01F 27/06
WO 2018/193504 A1 10/2018

OTHER PUBLICATIONS

Apr. 4, 2023 Office Action issued in Japanese Patent Application No. 2019-232038.

* cited by examiner

*Primary Examiner* — Tuyen T Nguyen
(74) *Attorney, Agent, or Firm* — Oliff PLC

(57) ABSTRACT

The first core includes a main body part extending in a first direction along a main surface of the substrate, a first foot part extending from the main body part to the second core through the substrate, and a second foot part extending from the main body part to the second core through the substrate at a position at which the coil conductor is sandwiched between itself and the first foot part in the first direction, and the insulating member includes a bottom wall part interposed between at least the first foot part and the second core, and a side wall part extending along at least either of the first foot part and the second foot part and interposed between either of the foot parts and the coil conductor.

9 Claims, 5 Drawing Sheets

COIL STRUCTURE

CROSS REFERENCE TO RELATED APPLICATIONS

This application claims priority to Japanese Patent Application No. 2019-232038 filed on Dec. 23, 2019, the entire contents of which are incorporated by reference herein.

TECHNICAL FIELD

The present disclosure relates to a coil structure.

BACKGROUND

Conventionally, as a coil structure, one described in PCT International Publication No. WO 2018/193504 is known. This coil structure includes a substrate having a coil conductor, a first core disposed on one side of the substrate, and a second core disposed on the other side of the substrate. The first core is an E-type core and the second core is an I-type core.

SUMMARY

Here, in the coil structure as described above, it is required to reduce the size and improve the performance.

An objective of the present disclosure is to provide a coil structure in which reduction in size can be achieved and a performance can be improved.

A coil structure according to the present disclosure includes a substrate including a coil conductor, a first core disposed on one main surface side of the substrate, a second core disposed on other main surface side of the substrate; and an insulating member made of an insulating material, in which the first core includes a main body part extending in a first direction along a main surface of the substrate, a first foot part extending from the main body part to the second core through the substrate, and a second foot part extending from the main body part to the second core through the substrate at a position at which the coil conductor is sandwiched between the second foot part and the first foot part in the first direction, and the insulating member includes a bottom wall part interposed between at least the first foot part and the second core, and a side wall part extending along at least either of the first foot part and the second foot part and interposed between either of the foot parts and the coil conductor.

In the coil structure according to the present disclosure, the insulating member includes the bottom wall part interposed between the first foot part and the second core. Thereby, the insulating member can adjust an L value between the first core and the second core. Here, the insulating member includes a side wall part extending along at least either of the first foot part and the second foot part and interposed between either of the foot parts and the coil conductor. In this case, the side wall part can function as a positioning part for the first core. Therefore, when a gap is formed between the first foot part of the first core and the second core, fixing, positioning, and checking of the insulating member can be easily performed. As described above, since the processing can be easily performed, deviations or the like between the members can be prevented and a performance of the coil structure can be improved. Also, the side wall part is interposed between either of the foot parts and the coil conductor. In this case, when it is necessary to secure an insulating distance between the foot parts and the coil conductor, since the insulating member is disposed between the foot parts and the coil conductor, a distance between the foot parts and the coil conductor can be decreased. Thereby, reduction in size of the coil structure can be achieved.

A pair of the first foot parts may extend from both end sides of the main body part in the first direction, and the second foot part may be disposed on an inner circumferential side of the coil conductor between the pair of first foot parts. In this case, the coil structure of the present disclosure can be applied to an EI core.

The insulating member may include a first side wall part extending along a side surface on an inner side in the first direction of the first foot part and interposed between the first foot part and the coil conductor. Thereby, a distance between the first foot part and the coil conductor in the first direction can be decreased.

The insulating member may include a second side wall part extending along a side surface in the first direction of the second foot part and interposed between the second foot part and the coil conductor. Thereby, a distance between the second foot part and the coil conductor in the first direction can be decreased.

A direction extending along the main surface of the substrate and intersecting the first direction is a second direction, and the insulating member may include a third side wall part extending along a side surface in the second direction of the second foot part and interposed between the second foot part and the coil conductor. In this case, a distance between the second foot part and the coil conductor in the second direction can be decreased.

The insulating member may include an upper wall part extending in the first direction along the main body part between the first foot part and the second foot part. In this case, a distance between the main body part and the coil conductor can be decreased.

The insulating member may include a fourth side wall part extending along a side surface on an outer side in the first direction of the first foot part. In this case, when another conductor is present on the outer side in the first direction of the first foot part, a distance between the conductor and the first foot part in the first direction can be decreased.

A heat dissipation material may be disposed in a gap between the second foot part and the second core. Thereby, the heat dissipation path can be formed between the second foot part and the second core in which heat is easily accumulated.

The insulating member may include a second side wall part extending along a side surface in the first direction of the second foot part and interposed between the second foot part and the coil conductor, and the second side wall part may extend to the second core side with respect to a lower surface of the second foot part. In this case, a vicinity of an end portion of the second side wall part on the second core side can block the heat dissipation material.

According to the present disclosure, it is possible to provide a coil structure in which reduction in size can be achieved and a performance can be improved.

DETAILED DESCRIPTION

Figure 1:
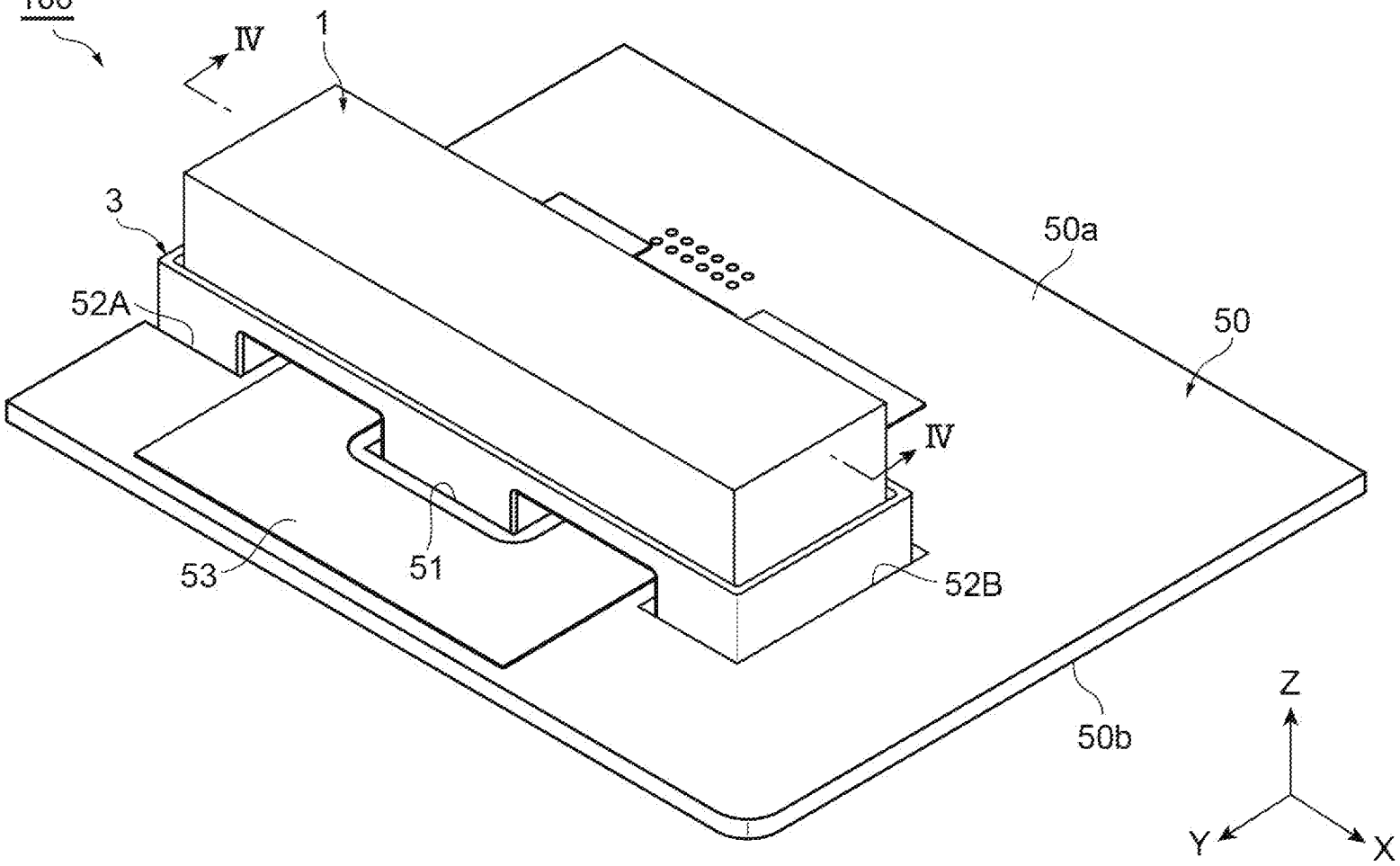
FIG. 1 is a perspective view illustrating a coil structure according to an embodiment of the present disclosure.
Figure 2:
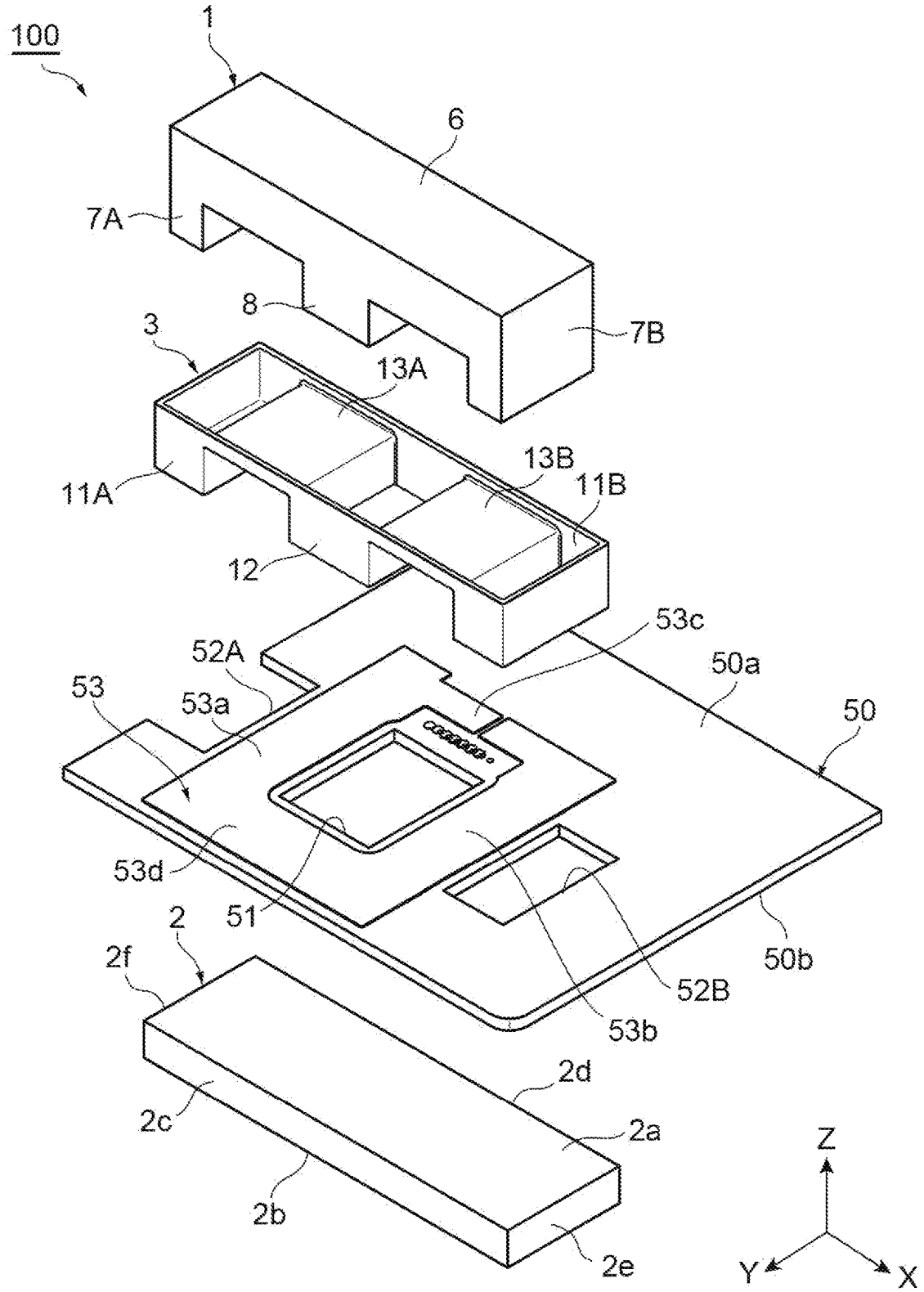
FIG. 2 is an exploded perspective view of the coil structure.
Figure 3:
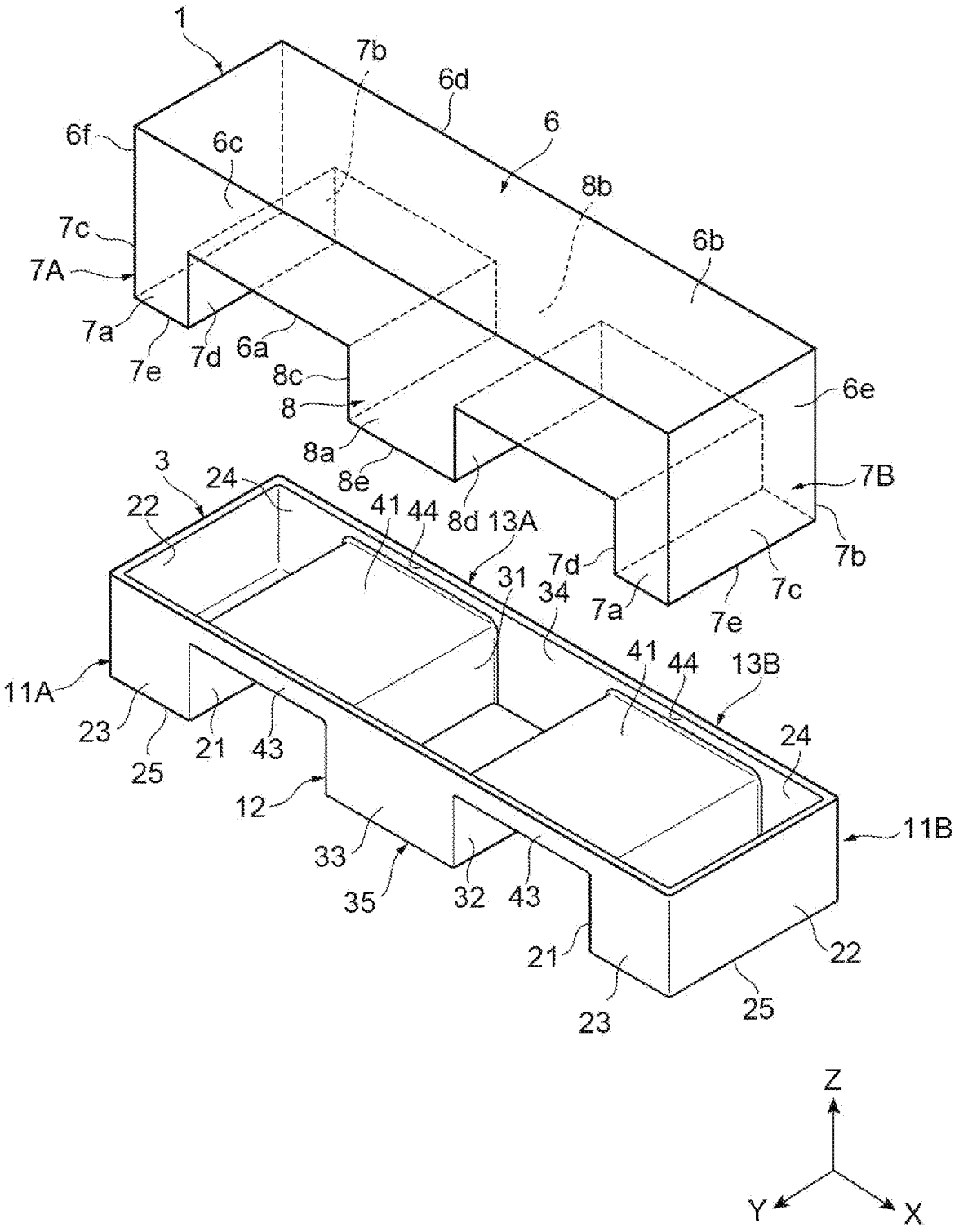
FIG. 3 is an enlarged perspective view of a first core and an insulating member illustrated in FIG. 2.
Figure 4:
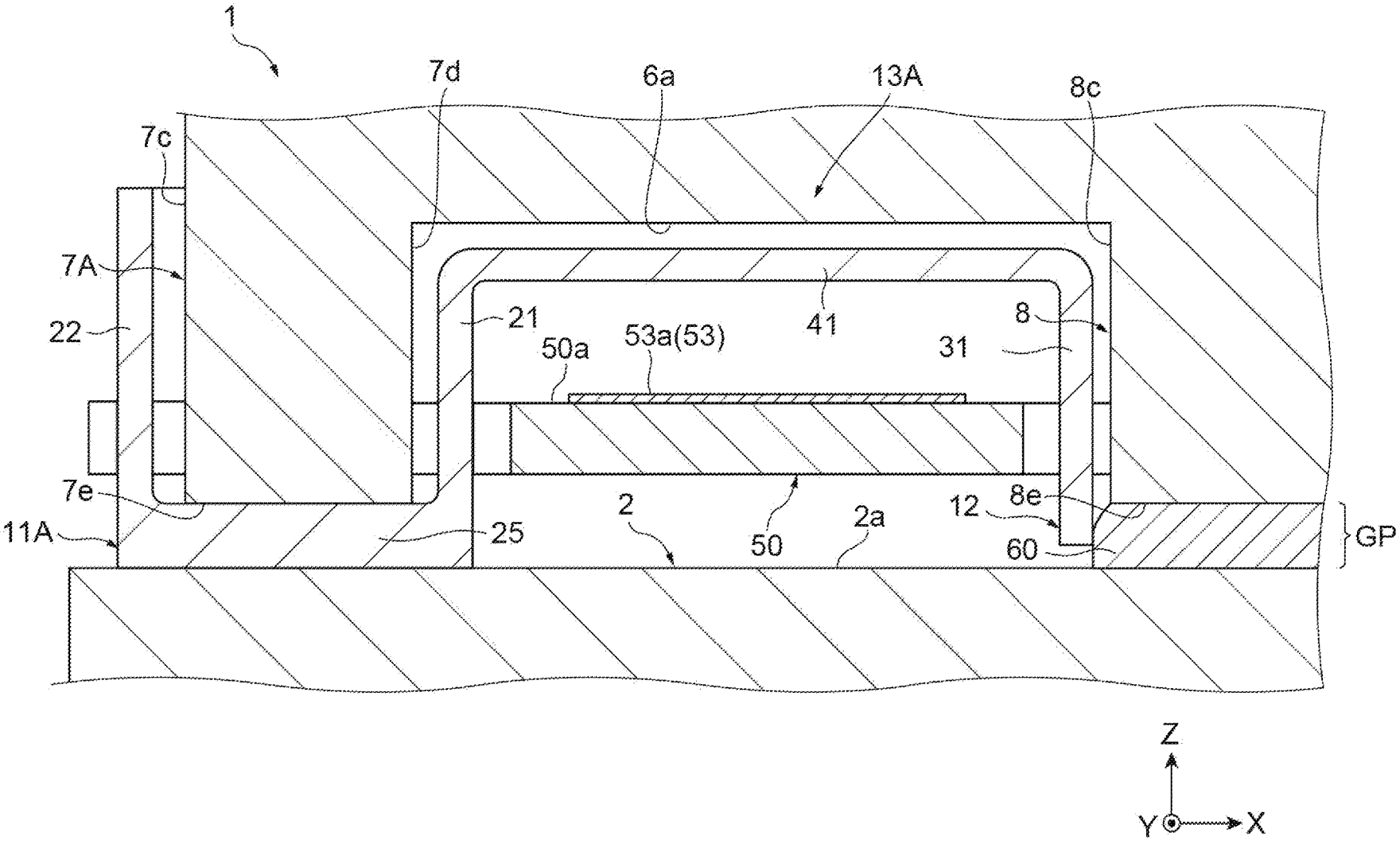
FIG. 4 is an enlarged cross-sectional view along line IV-IV of FIG. 1.

A coil structure according to an embodiment of the present disclosure will be described with reference to FIGS. 1 to 4. FIG. 1 is a perspective view illustrating a coil structure 100 according to an embodiment of the present disclosure. FIG. 2 is an exploded perspective view of the coil structure 100. FIG. 3 is an enlarged perspective view of a first core 1 and an insulating member 3 illustrated in FIG. 2. FIG. 4 is an enlarged cross-sectional view along line IV-IV of FIG. 1.

As illustrated in FIGS. 1 and 2, the coil structure 100 includes a substrate 50, a first core 1, a second core 2, and an insulating member 3. A facing direction in which the first core 1 and the second core 2 face each other is referred to as a Z-axis direction. Further, the first core 1 side is referred to as a positive side in the Z-axis direction. A direction perpendicular to the Z-axis direction, that is, a direction along the substrate 50 is referred to as an X-axis direction, and a direction perpendicular to the Z-axis direction and the X-axis direction is referred to as a Y-axis direction. Further, in the present embodiment, the X-axis direction corresponds to a "first direction" in the claims, and the Y-axis direction corresponds to a "second direction" in the claims. However, the present disclosure is not limited to this correspondence relationship.

The substrate 50 is a plate-shaped member that extends in an XY plane. The substrate 50 includes a main surface 50*a* on the positive side in the Z-axis direction and a main surface 50*b* on a negative side in the Z-axis direction. A rectangular penetration part 51 is formed in the substrate 50. Also, the substrate 50 includes a rectangular penetration part 52A formed at a position separated from the penetration part 51 on a negative side in the X-axis direction. The substrate 50 includes a rectangular penetration part 52B formed at a position separated from the penetration part 51 on a positive side in the X-axis direction. The substrate 50 includes a coil conductor 53 on the main surface 50*a*. The coil conductor 53 forms a winding part that is wound in a rectangular shape to surround the penetration part 51.

Specifically, as illustrated in FIG. 2, the coil conductor 53 includes side parts 53*a*, 53*b*, 53*c*, and 53*d*. The side part 53*a* is disposed on the negative side of the penetration part 51 in the X-axis direction. The side part 53*b* is disposed on the positive side of the penetration part 51 in the X-axis direction. The side part 53*c* is disposed on the negative side of the penetration part 51 in the Y-axis direction. The side part 53*d* is disposed on the positive side of the penetration part 51 in the Y-axis direction. Further, portions of the side parts 53*c* and 53*d* extend to positions corresponding to the penetration parts 52A and 52B in the X-axis direction.

The first core 1 is an E-shaped core. The first core 1 is disposed on the main surface 50*a* side of the substrate 50. The first core 1 includes a main body part 6, a pair of first foot parts 7A and 7B, and a second foot part 8. The first foot parts 7A and 7B penetrate the substrate 50 and extend to the second core 2. The first foot parts 7A and 7B are inserted into the penetration parts 52A and 52B of the substrate 50. The second foot part 8 penetrates the substrate 50 and extends to the second core 2. The second foot part 8 is inserted into the penetration part 51 of the substrate 50.

The first foot parts 7A and 7B protrude from the main body part 6 toward the negative side in the Z-axis direction. The first foot part 7A is provided at an end portion of the main body part 6 on the negative side in the X-axis direction. The first foot part 7B is provided at an end portion of the main body part 6 on the positive side in the X-axis direction. The first foot part 7A and the first foot part 7B are separated from each other in the X-axis direction. The second foot part 8 protrudes from the main body part 6 toward the negative side in the Z-axis direction between the first foot parts 7A and 7B. The second foot part 8 is disposed at a center position of the main body part 6 in the X-axis direction. The second foot part 8 is disposed at a position separated from the first foot part 7A on the positive side in the X-axis direction. The second foot part 8 is disposed at a position separated from the first foot part 7B on the negative side in the X-axis direction. A more detailed description of the first core 1 will be described below.

The second core 2 is an I-shaped core. The second core 2 is disposed on the main surface 50*b* side of the substrate 50. The second core 2 is magnetically connected to the first core 1 via the foot parts 7A, 7B, and 8. The second core 2 has a rectangular plate shape extending parallel to the XY plane. The second core 2 includes an upper surface 2*a*, a lower surface 2*b*, and side surfaces 2*c*, 2*d*, 2*e*, and 2*f*. The upper surface 2*a* extends parallel to the XY plane at a position on the positive side in the Z-axis direction. The lower surface 2*b* extends parallel to the XY plane at a position on the negative side in the Z-axis direction. The side surfaces 2*c* and 2*d* extend parallel to an XZ plane at positions on the positive side and the negative side in the Y-axis direction. The side surfaces 2*e* and 2*f* extend parallel to a YZ plane at positions on the positive side and the negative side in the X-axis direction.

The insulating member 3 is a member made of an insulating material. The "insulating material" is a material constituting an insulator, and for example, a phenol resin or the like may be employed. The insulating member 3 is a member for securing insulation between the first core 1 and other parts. Also, the insulating member 3 is a member that forms gaps between the first foot parts 7A and 7B of the first core 1 and the second core 2 and allows positioning of the first core 1. The insulating member 3 includes a pair of accommodating parts 11A and 11B, an accommodating part 12, and a pair of connecting parts 13A and 13B. The first accommodating parts 11A and 11B are portions that accommodate the first foot parts 7A and 7B of the first core 1. The second accommodating part 12 is a portion that accommodates the second foot part 8 of the first core 1. The connecting part 13A is a portion connecting the first accommodating part 11A and the second accommodating part 12. The connecting part 13B is a portion connecting the first accommodating part 11B and the second accommodating part 12. A more detailed description of the insulating member 3 will be described below.

Next, a detailed configuration of the first core 1 will be described with reference to FIG. 3. The main body part 6 is formed in a rectangular parallelepiped shape having a longitudinal direction in the X-axis direction. The main body part 6 includes a lower surface 6*a*, an upper surface 6*b*, side surfaces 6*c* and 6*d*, and end surfaces 6*e* and 6*f*. The lower surface 6*a* extends parallel to the XY plane at a position on the negative side in the Z-axis direction. The upper surface 6*b* extends parallel to the XY plane at a position on the positive side in the Z-axis direction. The side surfaces 6*c* and 6*d* extend parallel to the XZ plane at positions on the positive side and the negative side in the Y-axis direction.

The end surfaces 6*e* and 6*f* extend parallel to the YZ plane at positions on the positive side and the negative side in the X-axis direction.

The first foot parts 7A and 7B each have a rectangular shape when viewed from the Z-axis direction. The first foot parts 7A and 7B each have side surfaces 7*a*, 7*b*, 7*c*, and 7*d*, and a lower surface 7*e*. The side surfaces 7*a* and 7*b* extend parallel to the XZ plane at positions on the positive side and the negative side in the Y-axis direction. The side surfaces 7*c* and 7*d* extend parallel to the YZ plane at positions on an outer side and an inner side in the X-axis direction. Further, the "outer side in the X-axis direction" is based on the longitudinal direction of the main body part 6 and indicates the end surfaces 6*e* and 6*f* sides. The lower surface 7*e* extends parallel to the XY plane at a position on the negative side of the substrate 50 in the Z-axis direction. In the present embodiment, the side surfaces 7*a* and 7*b* of the first foot parts 7A and 7B form the same plane as the side surfaces 6*c* and 6*d* of the main body part 6, respectively. The side surface 7*c* of the first foot part 7A forms the same plane as the end surface 6*e* of the main body part 6. The side surface 7*c* of the first foot part 7B forms the same plane as the end surface 6*f* of the main body part 6.

The second foot part 8 has a rectangular shape when viewed from the Z-axis direction. The second foot part 8 includes side surfaces 8*a*, 8*b*, 8*c*, and 8*d*, and a lower surface 8*e*. The side surfaces 8*a* and 8*b* extend parallel to the XZ plane at positions on the positive side and the negative side in the Y-axis direction. The side surfaces 8*c* and 8*d* extend parallel to the YZ plane at positions on the positive side and the negative side in the X-axis direction. The lower surface 8*e* extends parallel to the XY plane at a position on the negative side of the substrate 50 in the Z-axis direction. In the present embodiment, the side surfaces 8*a* and 8*b* of the second foot part 8 form the same plane as the side surfaces 6*c* and 6*d* of the main body part 6, respectively. However, shapes of the first foot parts 7A and 7B and the second foot part 8 and positional relationships thereof with the main body part 6 are not particularly limited.

The lower surfaces 7*e* of the first foot parts 7A and 7B and the lower surface 8*e* of the second foot part 8 of the first core 1 are disposed to be parallel to and close to the upper surface 2*a* of the second core 2. Further, positions of the lower surfaces 7*e* of the first foot parts 7A and 7B and the lower surface 8*e* of the second foot part 8 in the Z-axis direction may be the same as each other but may also be slightly deviated from each other.

Next, a detailed configuration of the insulating member 3 will be described with reference to FIGS. 3 and 4. Further, the insulating member 3, the first core 1, and the second core 2 have a configuration that is line-symmetric with respect to a center line in the X-axis direction when viewed from the Y-axis direction. Therefore, although only a configuration thereof on the negative side in the X-axis direction is illustrated in FIG. 4, a configuration thereof on the positive side in the X-axis direction also has the same effect. Further, in the following description, a state in which the insulating member 3 is assembled to the first core 1 (states illustrated in FIGS. 1 and 4) will be described.

As illustrated in FIG. 3, the accommodating part 11A includes a side wall part 21 (side wall part, first side wall part), a side wall part 22 (fourth side wall part), side wall parts 23 and 24 (side wall parts), and a bottom wall part 25.

The side wall part 21 of the accommodating part 11A extends along the side surface 7*d* on the inner side in the X-axis direction of the first foot part 7A and is interposed between the first foot part 7A and the coil conductor 53. The side wall part 21 extends parallel to the YZ plane to cover the side surface 7*d* at a position on the positive side of the side surface 7*d* in the X-axis direction. The side wall part 21 of the accommodating part 11A is interposed between the side surface 7*d*, and an edge portion of the penetration part 51 and the side part 53*a* of the coil conductor 53 (see FIG. 2).

The side wall part 22 of the accommodating part 11A extends along the side surface 7*c* on the outer side in the X-axis direction of the first foot part 7A. The side wall part 22 extends parallel to the YZ plane to cover the side surface 7*c* at a position on the negative side of the side surface 7*c* in the X-axis direction.

The side wall part 23 of the accommodating part 11A extends along the side surface 7*a* on the positive side in the Y-axis direction of the first foot part 7A. The side wall part 23 extends parallel to the XZ plane to cover the side surface 7*a* at a position on the positive side of the side surface 7*a* in the Y-axis direction. Both end portions of the side wall part 23 in the X-axis direction are connected to end portions of the side wall parts 21 and 22 on the positive side in the Y-axis direction. The side wall part 23 of the accommodating part 11A is interposed between the side surface 7*a*, and an edge portion of the penetration part 52A and an extended portion of the side part 53*d* of the coil conductor 53 (see FIG. 2). Therefore, in the present embodiment, the side wall part 23 of the accommodating part 11A is interposed between the first foot part 7A and the coil conductor 53.

The side wall part 24 of the accommodating part 11A extends along the side surface 7*b* on the negative side in the Y-axis direction of the first foot part 7A. The side wall part 24 extends parallel to the XZ plane to cover the side surface 7*b* at a position on the negative side of the side surface 7*b* in the Y-axis direction. Both end portions of the side wall part 24 in the X-axis direction are connected to end portions of the side wall parts 21 and 22 on the negative side in the Y-axis direction. The side wall part 24 of the accommodating part 11A is interposed between the side surface 7*b*, and an edge portion of the penetration part 52A and an extended portion of the side part 53*c* of the coil conductor 53 (see FIG. 2). Therefore, in the present embodiment, the side wall part 24 of the accommodating part 11A is interposed between the first foot part 7A and the coil conductor 53.

The bottom wall part 25 of the accommodating part 11A extends along the lower surface 7*e* of the first foot part 7A. The bottom wall part 25 is interposed between the first foot part 7A and the second core 2. The bottom wall part 25 extends parallel to the XY plane to cover the lower surface 7*e* at a position on the negative side of the lower surface 7*e* in the Z-axis direction. The bottom wall part 25 is in contact with the lower surface 7*e* of the first foot part 7A on an upper surface side and in contact with the upper surface 2*a* of the second core 2 on a lower surface side. Both end portions of the bottom wall part 25 in the X-axis direction are connected to end portions of the side wall parts 21 and 22 on the negative side in the Z-axis direction. Both end portions of the bottom wall part 25 in the Y-axis direction are connected to end portions of the side wall parts 23 and 24 on the negative side in the Z-axis direction.

The accommodating part 11B includes a side wall part 21 (side wall part, first side wall part), a side wall part 22 (fourth side wall part), side wall parts 23 and 24 (side wall parts, third side wall parts), and a bottom wall part 25. The accommodating part 11B has a configuration of the same effect as that of the accommodating part 11A except that the side wall part 21 is disposed on the negative side of the first foot part 7B in the X-axis direction, and the side wall part 22 is disposed on the positive side of the first foot part 7B in the X-axis direction.

The accommodating part 12 includes side wall parts 31 and 32 (side wall parts, second side wall parts), and side wall parts 33 and 34 (side wall parts, third side wall parts).

The side wall part 31 of the accommodating part 12 extends along the side surface 8*c* on the negative side in the X-axis direction of the second foot part 8, and is interposed between the second foot part 8 and the coil conductor 53. The side wall part 31 extends parallel to the YZ plane to cover the side surface 8*c* at a position on the negative side of the side surface 8*c* in the X-axis direction. The side wall part 31 of the accommodating part 12 is interposed between the side surface 8*c*, and an edge portion of the penetration part 51 and the side part 53*a* of the coil conductor 53 (see FIG. 2).

The side wall part 32 of the accommodating part 12 extends along the side surface 8*d* on the positive side in the X-axis direction of the second foot part 8 and is interposed between the second foot part 8 and the coil conductor 53. The side wall part 32 extends parallel to the YZ plane to cover the side surface 8*d* at a position on the positive side of the side surface 8*d* in the X-axis direction. The side wall part 32 of the accommodating part 12 is interposed between the side surface 8*d*, and an edge portion of the penetration part 51 and the side part 53*b* of the coil conductor 53 (see FIG. 2).

The side wall part 33 of the accommodating part 12 extends along the side surface 8*a* on the positive side in the Y-axis direction of the second foot part 8 and is interposed between the second foot part 8 and the coil conductor 53. The side wall part 33 extends parallel to the XZ plane to cover the side surface 8*a* at a position on the positive side of the side surface 8*a* in the Y-axis direction. Both end portions of the side wall part 33 in the X-axis direction are connected to end portions on the positive side of the side wall parts 31 and 32 in the Y-axis direction. The side wall part 33 of the accommodating part 12 is interposed between the side surface 8*a*, and an edge portion of the penetration part 51 and the side part 53*d* of the coil conductor 53 (see FIG. 2).

The side wall part 34 of the accommodating part 12 extends along the side surface 8*b* on the negative side in the Y-axis direction of the second foot part 8 and is interposed between the second foot part 8 and the coil conductor 53. The side wall part 34 extends parallel to the XZ plane to cover the side surface 8*b* at a position on the negative side of the side surface 8*b* in the Y-axis direction. Both end portions of the side wall part 34 in the X-axis direction are connected to end portions on the negative side of the side wall parts 31 and 32 in the Y-axis direction. The side wall part 34 of the accommodating part 12 is interposed between the side surface 8*b*, and an edge portion of the penetration part 51 and the side part 53*c* of the coil conductor 53 (see FIG. 2).

End portions on the negative side of the side wall parts 31, 32, 33, and 34 in the Z-axis direction are free end portions without being provided with a bottom wall part. Thereby, an opening 35 is formed on a bottom surface side of the accommodating part 12. The lower surface 8*e* of the second foot part 8 and the upper surface 2*a* of the second core 2 face each other via the opening 35 in a state in which they are separated from each other in the Z-axis direction. Thereby, a gap GP is formed between the second foot part 8 and the second core 2. As illustrated in FIG. 4, a heat dissipation material 60 is disposed in the gap GP. The heat dissipation material 60 is in contact with the lower surface 8*e* of the second foot part 8 and the upper surface 2*a* of the second core 2. The heat dissipation material 60 is formed to thermally connect the lower surface 8*e* of the second foot part 8 and the upper surface 2*a* of the second core 2. The heat dissipation material 60 is formed by being filled into the gap GP in a state of having fluidity and is then cured. Further, the heat dissipation material 60 is made of a material having a higher thermal conductivity than the insulating member 3 and a general gap sheet, and for example, a gap filler or the like may be employed.

The side wall parts 31, 32, 33, and 34 extend to the second core 2 side (that is, the negative side in the Z-axis direction) with respect to the substrate 50 and the lower surface 8*e* of the second foot part 8. Lower end portions of the side wall parts 31, 32, 33, and 34 are disposed at positions slightly separated from the upper surface 2*a* of the second core 2. Thereby, the side wall parts 31, 32, 33, and 34 protrude in the Z-axis direction from four edge portions of the lower surface 8*e*. The side wall parts 31, 32, 33, and 34 are disposed to surround and partition the gap GP. Therefore, the side wall parts 31, 32, 33, and 34 can inhibit the heat dissipation material 60 flowing out before it is cured when the heat dissipation material 60 is filled into the gap GP.

As illustrated in FIG. 3, the connecting part 13A includes an upper wall part 41 and side wall parts 43 and 44. The connecting part 13B includes an upper wall part 41 and side wall parts 43 and 44. Since a configuration of the connecting part 13B has the same effect as that of the connecting part 13A, description thereof will be omitted.

The upper wall part 41 extends in the X-axis direction along the main body part 6 between the first foot part 7A and the second foot part 8. The upper wall part 41 is interposed between the main body part 6 and the coil conductor 53. The upper wall part 41 extends parallel to the XY plane to cover the lower surface 6*a* at a position on the negative side of the lower surface 6*a* of the main body part 6 in the Z-axis direction. Both end portions of the upper wall part 41 in the X-axis direction are connected to end portions of the side wall parts 21 and 31 on the positive side in the Z-axis direction. The upper wall part 41 is interposed between the lower surface 6*a* and the side part 53*a* of the coil conductor 53 (see FIG. 2).

The side wall part 43 rises from an end portion of the upper wall part 41 on the positive side in the Y-axis direction to the positive side in the Z-axis direction. The side wall part 43 faces the side surface 6*c* of the main body part 6 in the Y-axis direction. The side wall part 43 is connected to the side wall parts 23 and 33 to form the same plane as the side wall part 23 and the side wall part 33. The side wall part 44 rises from an end portion of the upper wall part 41 on the negative side in the Y-axis direction to the positive side in the Z-axis direction. The side wall part 44 faces the side surface 6*d* of the main body part 6 in the Y-axis direction. The side wall part 44 is connected to the side wall parts 24 and 34 to form the same plane as the side wall part 24 and the side wall part 34.

Next, the operation and effects of the coil structure 100 according to the present embodiment will be described.

In the coil structure 100 according to the present disclosure, the insulating member 3 includes the bottom wall parts 25 each interposed between the pair of first foot parts 7A and 7B and the second core 2. Thereby, the insulating member 3 can adjust an L value between the first foot parts 7A and 7B and the second core 2.

Figure 5:
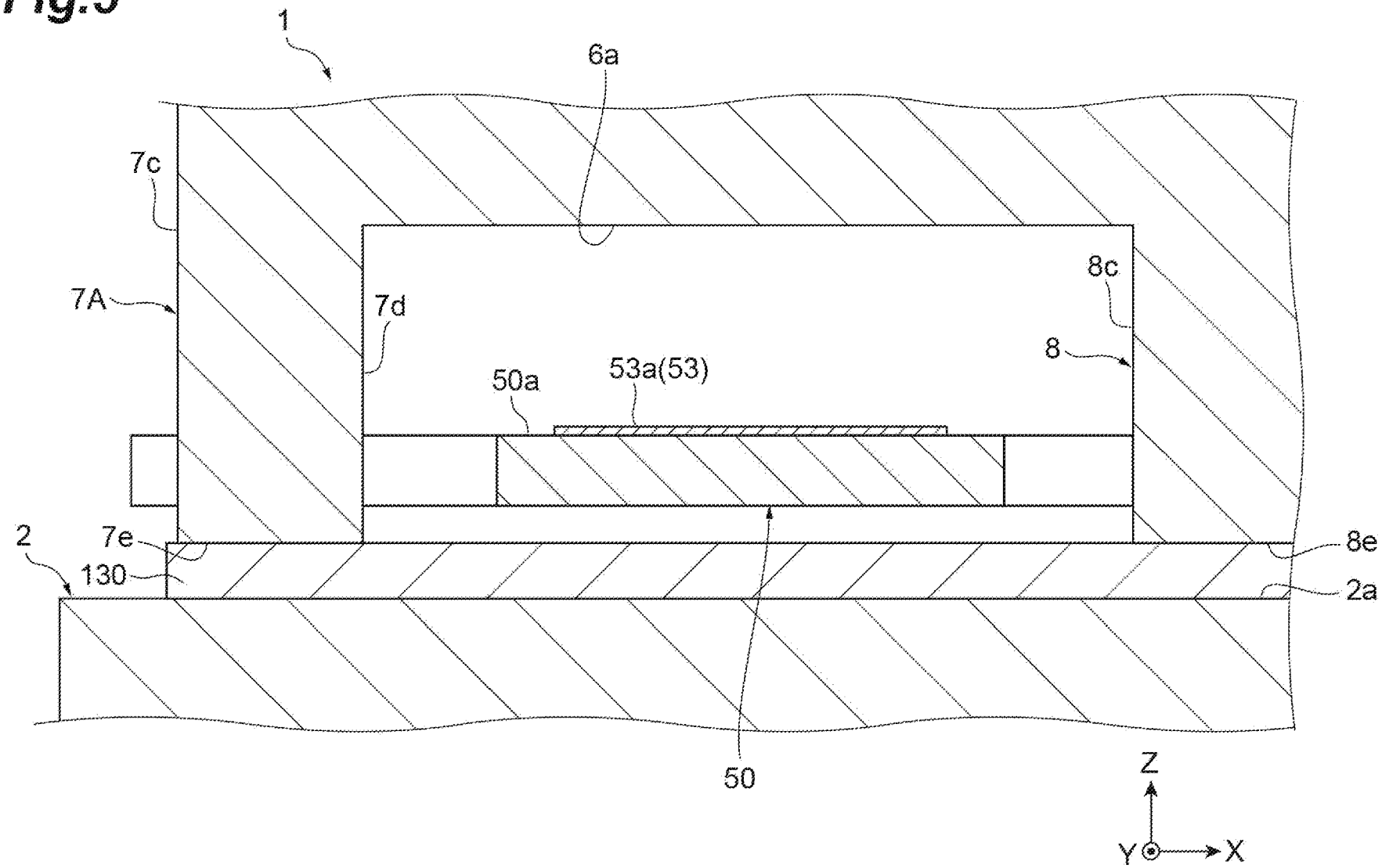
FIG. 5 is an enlarged cross-sectional view of a coil structure according to a comparative example.

Here, in a coil structure according to a comparative example illustrated in FIG. 5, a gap sheet 130 is used to adjust gaps between the first foot parts 7A and 7B and the second core 2. However, when such a gap sheet 130 is used, it is difficult for the first core 1 to be positioned and fixed with respect to the gap sheet 130. Therefore, there is a possibility that a position of the first core 1 with respect to the second core 2 will be deviated. Also, it becomes difficult to check the positional deviation.

In contrast, in the present embodiment, the insulating member 3 extends along the pair of first foot parts 7A and 7B and the second foot part 8, and includes the side wall parts 21, 23, 24, 31, 32, 33, and 34 interposed between these foot parts 7A, 7B, and 8 and the coil conductor 53. In this case, the side wall parts 21, 23, 24, 31, 32, 33, and 34 can function as positioning parts for the first core 1. Therefore, when a gap is formed between the first foot parts 7A and 7B of the first core 1 and the second core 2, fixing, positioning, and checking of the insulating member 3 can be easily performed. As described above, since the processing can be easily performed, deviations or the like between the members can be prevented and a performance of the coil structure 100 can be improved.

Here, for example, in a structure of a DC-DC converter for vehicles, the cores 1 and 2 and the coil conductor 53 should all be set to a primary side voltage (dangerous voltage) of a circuit from a viewpoint of safety standards. However, for heat dissipation of the cores 1 and 2, it is necessary to bring the cores 1 and 2 into contact with a heat dissipation member (provided on a lower surface side of the second core 2). Therefore, a portion of the coil conductor 53 becomes a primary side voltage, and the cores 1 and 2 become a secondary side voltage (safety voltage). Here, there are cases in which a safety distance standard of the DC-DC converter is determined to be, for example, 2.6 mm. In the coil structure according to the comparative example illustrated in FIG. 5, only a space is formed between the coil conductor 53 and the first core 1. Therefore, it is necessary to secure a safety distance according to the standard between the coil conductor 53 and each side surface of the foot parts 7A, 7B, and 8. For example, as the distances illustrated in FIG. 5, it is necessary to secure large distances between the side surface 7*d* of the first foot part 7A and the coil conductor 53, between the second foot part 8 and the coil conductor 53, and between the lower surface 6*a* of the main body part 6 and the coil conductor 53. Thereby, a problem occurs in that the coil structure becomes large.

In contrast, in the present embodiment, the side wall parts 21, 23, 24, 31, 32, 33, and 34 are interposed between the foot parts 7A, 7B, and 8 and the coil conductor 53. In this case, since the insulating member 3 is disposed between the foot parts 7A, 7B, and 8 and the coil conductor 53, distances between the foot parts 7A, 7B, and 8 and the coil conductor 53 can be decreased. Thereby, reduction in size of the coil structure 100 can be achieved.

The pair of first foot parts 7A and 7B may extend from both end sides of the main body part 6 in the X-axis direction, and the second foot part 8 may be disposed on an inner circumferential side of the coil conductor 53 between the pair of first foot parts 7A and 7B. In this case, the coil structure 100 of the present disclosure can be applied to an EI core.

The insulating member 3 includes the side wall parts 21 which extend along the side surfaces 7*d* on the inner side in the X-axis direction of the first foot parts 7A and 7B and are interposed between the first foot parts 7A and 7B and the coil conductor 53. Thereby, distances between the first foot parts 7A and 7B and the coil conductor 53 in the X-axis direction can be decreased.

The insulating member 3 includes the side wall parts 31 and 32 which extend along the side surfaces 8*c* and 8*d* in the X-axis direction of the second foot part 8 and are interposed between the second foot part 8 and the coil conductor 53. Thereby, a distance between the second foot part 8 and the coil conductor 53 in the X-axis direction can be decreased.

The insulating member 3 includes the side wall parts 33 and 34 which extend along the side surfaces 8*a* and 8*b* in the Y-axis direction of the second foot part 8 and are interposed between the second foot part 8 and the coil conductor 53. In this case, a distance between the second foot part 8 and the coil conductor 53 in the Y-axis direction can be decreased.

The insulating member 3 includes the upper wall parts 41 which extend in the X-axis direction along the main body part 6 between the first foot parts 7A and 7B and the second foot part 8. In this case, a distance between the main body part 6 and the coil conductor 53 can be decreased.

The insulating member 3 includes the side wall parts 22 which extend along the side surfaces 7*c* on the outer side in the X-axis direction of the first foot parts 7A and 7B. In this case, when other conductors are present on the outer side of the first foot parts 7A and 7B in the X-axis direction, distances between the conductors and the first foot parts 7A and 7B in the X-axis direction can be decreased.

The heat dissipation material 60 may be disposed in the gap GP between the second foot part 8 and the second core 2. Thereby, a heat dissipation path can be formed between the second foot part 8 and the second core 2 in which heat is easily accumulated.

The insulating member 3 includes the side wall parts 31 and 32 which extend along the side surfaces 8*c* and 8*d* in the X-axis of the second foot part 8 direction and are interposed between the second foot part 8 and the coil conductor 53, and the side wall parts 31 and 32 extend to the second core 2 side with respect to the lower surface 8*e* of the second foot part 8. In this case, vicinities of the end portions of the side wall parts 31 and 32 on the second core 2 side can block the heat dissipation material 70.

The present disclosure is not limited to the embodiment described above.

The configuration of the insulating member 3 is not limited to the above-described embodiment. For example, the side wall parts 22, 23, 24, 43, and 44 may be omitted from the insulating member 3. Also, the insulating member 3 need only include at least one side wall part which extends along at least either of the first foot part and the second foot part and is interposed between either of the foot parts and the coil conductor 53.

In the embodiment described above, the EI core has been described as an example. However, the coil structure of the present disclosure is not particularly limited in types of core, and can also be applied to UI cores, EE cores, UU cores, or the like.

A coil structure in a case of a UI core has a configuration in which portions of the first foot part 7B and the corresponding insulating member 3 are removed from the above-described embodiment. Specifically, the first foot part 7B and a portion on the positive side of the second foot part 8 in the X-axis direction in the main body part 6 are omitted from the first core 1, and thereby a U-shaped first core is formed. Also, the first accommodating part 11B and the connecting part 13B are omitted from the insulating member 3.

As a coil structure in a case of an EE core, in the above-described embodiment, an E-shaped core having the same configuration as the first core 1 is employed as the second core instead of the I-shaped core. In this case, the second core is disposed with the first core 1 inverted upside down in the Z-axis direction. Thereby, the foot parts 7A, 7B, and 8 of the first core 1 are connected to the foot parts 7A, 7B, and 8 of the second core. Further, the insulating member 3 may be provided also with respect to the second core. A coil structure in a case of a UU core has a configuration in which the U-shaped core described in the UI core is used as the first coil and the second coil.

Embodiment 1. A coil structure comprising:

a substrate including a coil conductor;

a first core disposed on one main surface side of the substrate;

a second core disposed on the other main surface side of the substrate; and an insulating member made of an insulating material, wherein the first core includes:

a main body part extending in a first direction along a main surface of the substrate;

a first foot part extending from the main body part to the second core through the substrate; and a second foot part extending from the main body part to the second core through the substrate at a position at which the coil conductor is sandwiched between the second foot part and the first foot part in the first direction, and the insulating member includes:

a bottom wall part interposed between at least the first foot part and the second core; and a side wall part extending along at least either of the first foot part and the second foot part and interposed between either of the foot parts and the coil conductor.

Embodiment 2. The coil structure according to embodiment 1, wherein a pair of the first foot parts extend from both end sides of the main body part in the first direction, and the second foot part is disposed on an inner circumferential side of the coil conductor between the pair of first foot parts.

Embodiment 3. The coil structure according to embodiment 1 or 2, wherein the insulating member includes a first side wall part extending along a side surface on an inner side in the first direction of the first foot part and interposed between the first foot part and the coil conductor.

Embodiment 4. The coil structure according to any one of embodiments 1 to 3, wherein the insulating member includes a second side wall part extending along a side surface in the first direction of the second foot part and interposed between the second foot part and the coil conductor.

Embodiment 5. The coil structure according to any one of embodiments 1 to 4, wherein a direction extending along the main surface of the substrate and intersecting the first direction is a second direction, and the insulating member includes a third side wall part extending along a side surface in the second direction of the second foot part and interposed between the second foot part and the coil conductor.

Embodiment 6. The coil structure according to any one of embodiments 1 to 5, wherein the insulating member includes an upper wall part extending in the first direction along the main body part between the first foot part and the second foot part.

Embodiment 7. The coil structure according to any one of embodiments 1 to 6, wherein the insulating member includes a fourth side wall part extending along a side surface on an outer side in the first direction of the first foot part.

Embodiment 8. The coil structure according to any one of embodiments 1 to 7, wherein a heat dissipation material is disposed in a gap between the second foot part and the second core.

Embodiment 9. The coil structure according to embodiment 8, wherein the insulating member includes the second side wall part extending along a side surface in the first direction of the second foot part and interposed between the second foot part and the coil conductor, and the second side wall part extends to the second core side with respect to a lower surface of the second foot part.

REFERENCE SIGNS LIST

1 First core
2 Second core
3 Insulating member
7A, 7B First foot part
6 Main body part
8 Second foot part
21 Side wall part (side wall part, first side wall part)
22 Side wall part (fourth side wall part)
23, 24 Side wall part (side wall part)
25 Bottom wall part
31, 32 Side wall part (side wall part, second side wall part)
33, 34 Side wall part (side wall part, third side wall part)
41 Upper wall part
100 Coil structure

What is claimed is:

1. A coil structure comprising:

a substrate including a coil conductor;

a first core disposed on one main surface side of the substrate;

a second core disposed on other main surface side of the substrate; and an insulating member made of an insulating material, wherein the first core includes:

a main body part extending in a first direction along a main surface of the substrate;

a first foot part extending from the main body part to the second core through the substrate; and a second foot part extending from the main body part to the second core through the substrate at a position at which the coil conductor is sandwiched between the second foot part and the first foot part in the first direction, and the insulating member includes:

a bottom wall part interposed between at least the first foot part and the second core; and a side wall part extending along at least either of the first foot part and the second foot part and interposed between either of the foot parts and the coil conductor.

2. The coil structure according to claim 1, wherein a pair of the first foot parts extend from both end sides of the main body part in the first direction, and the second foot part is disposed on an inner circumferential side of the coil conductor between the pair of first foot parts.

3. The coil structure according to claim 1, wherein the insulating member includes a first side wall part extending along a side surface on an inner side in the first direction of the first foot part and interposed between the first foot part and the coil conductor.

4. The coil structure according to claim 1, wherein the insulating member includes a second side wall part extending along a side surface in the first direction of the second foot part in the first direction and interposed between the second foot part and the coil conductor.

5. The coil structure according to claim 1, wherein a direction extending along the main surface of the substrate and intersecting the first direction is a second direction, and the insulating member includes a third side wall part extending along a side surface in the second direction of the second foot part and interposed between the second foot part and the coil conductor.

6. The coil structure according to claim 1, wherein the insulating member includes an upper wall part extending in the first direction along the main body part between the first foot part and the second foot part.

7. The coil structure according to claim 1, wherein the insulating member includes a fourth side wall part extending along a side surface on an outer side in the first direction of the first foot part.

8. The coil structure according to claim 1, wherein a heat dissipation material is disposed in a gap between the second foot part and the second core.

9. The coil structure according to claim 8, wherein the insulating member includes a second side wall part extending along a side surface in the first direction of the second foot part and interposed between the second foot part and the coil conductor, and the second side wall part extends to the second core side with respect to a lower surface of the second foot part.

* * * * *